US005116364A

United States Patent [19]

Bassi et al.

[11] Patent Number: 5,116,364

[45] Date of Patent: May 26, 1992

[54] HARNESS CORD PULLEY ARRANGEMENT FOR JACQUARD SHED FORMING DEVICE

[75] Inventors: Dario Bassi, Chaponnay; Damien Bouchet, Decines, both of France

[73] Assignee: Etablissements STAUBLI-VERDOL, Chassieu, France

[21] Appl. No.: 623,227

[22] Filed: Dec. 6, 1990

[30] Foreign Application Priority Data

Dec. 15, 1989 [FR] France ..... 89 16938

[51] Int. Cl.[5] ..... D03C 3/06

[52] U.S. Cl. ..... 139/65; 254/337

[58] Field of Search ..... 254/337, 336, 338; 139/65, 60-64, 59

[56] References Cited

U.S. PATENT DOCUMENTS 1,307,578 6/1919 Cherry ..... 254/337 X
4,702,286 10/1987 Palau et al. ..... 139/65 X
4,969,490 11/1990 Seiler ..... 139/65

FOREIGN PATENT DOCUMENTS 212891 6/1957 Australia ..... 254/338
0307824 3/1989 European Pat. Off. ..... 139/65
367452 3/1963 Switzerland .

*Primary Examiner*—Andrew M. Falik
*Attorney, Agent, or Firm*—Dowell & Dowell

[57] ABSTRACT

A block and tackel arrangement for connecting the hooks of a shed forming device in a weaving loom with heddle or harness threads wherein the block and tackle arrangement includes an idler pulley (17) of reduced diameter which is mounted below conventional pulleys (6,8) about which different lines or cables are supported. A guide pulley (18) is provided at the base of the mechanism and the lower cable element (20) is fixed by one of its ends to a fixed point (21), extends over the idle pulley (17), the guide pulley (18) and pulley (8) with its free end carrying a collar (13a) to which is attached heddle or harness threads (15).

3 Claims, 1 Drawing Sheet

3
1d
2
1a
1
1c
4
1b
5
6
7
8
10
9
11
12
14
13
13a
15

1d
3
1c
1d
2
1a
1
1b
1c
4
1b
5
6
7
8
9
10
11
12
13
14
13a
15
A 3
1d
2
1
1a
1c
4
1b
5
6
16
8
17
21
18
19
20
13a
15
B 1d
3
1a
1d
2
1c
1
1b
1a
1c
4
1b
5
6
16
8
17
20
21
18
19
13a
15
A

HARNESS CORD PULLEY ARRANGEMENT FOR JACQUARD SHED FORMING DEVICE

BACKGROUND OF THE INVENTION

1. Field of the Invention

This invention is generally directed to block and tackle arrangements for connecting the hooks of a shed forming device of a weaving loom with the heddle or harness threads.

2. History of the Related Art

Shed forming devices have been known to exist for a long time, comprising knives moving in opposition in a reciprocating movement to cooperate with the hooks for controlling heddles or harness threads in a weaving loom. The hooks are connected by a cord which passes around the first pulley of a block and tackle of which the second pulley is surrounded by a cord having one of the ends secured to the frame, while the other end is associated with at least one heddle. Such a device is described in particular in Swiss Pat. No. CH-367 452.

Shed forming devices of this type allow a certain opening of the shed which is of the order of 100 mm. If it is desired to increase the magnitude of the shed, for example for making carpets or other fabrics, the free end of the cord mentioned above is attached to a fork joint in which is mounted an idle pulley guiding a funicular element of which one of the ends is fixed with respect to the loom frame, while its free end is associated with at least one heddle.

It will readily be appreciated that the block and tackle with two pulleys and the idle pulley must be offset longitudinally so as not to interfere. In the same way, it is necessary to guide them longitudinally to avoid their collision with the corresponding members of adjacent systems.

In view of these factors shed forming devices are complex to produce since it is necessary to provide the above-mentioned guides as well as the crosspieces which constitutes the points of anchoring of the cords and funicular elements.

The improvements forming the subject matter of the present invention aim at overcoming these drawbacks and at enabling a simple shed forming device to be produced which is of small dimensions and of economical cost.

SUMMARY OF THE INVENTION

In the present invention, the idle pulley used in the prior art technique in association with the cord is mounted to rotate in the block and tackle which includes three pulleys, the funicular element passes from its point of anchoring successively around the idle pulley or third pulley of the block and tackle, then around a guide pulley of which the fork joint is fixed, in order then to surround the second pulley of the block and tackle and finally hang vertically to be associated with at least one heddle or harness threads.

Thanks to this arrangement, the pitch of the shed may be doubled, or, by conserving the magnitude thereof, the stroke of the knives may be reduced by half.

Of course, although double hooks such as those described in Pat. No. CH-367 452 may be used for each system, it is particularly advantageous to employ a shed forming device such as the one described in Applicants' French Pat. No. FR-2 587 045 in which it is perfectly simple to provide between two adjacent partitions a transverse pin around which the guide pulley freely rotates, while the point of anchoring of the funicular element is directly located on one of its separating partitions.

BRIEF DESCRIPTION OF THE DRAWINGS

The accompanying drawings, given by way of example, will enable the invention, the characteristics that it presents and the advantages that it is capable of procuring, to be more readily understood.

DESCRIPTION OF THE PREFERRED EMBODIMENT

Figures 1, 2, 3, 4:
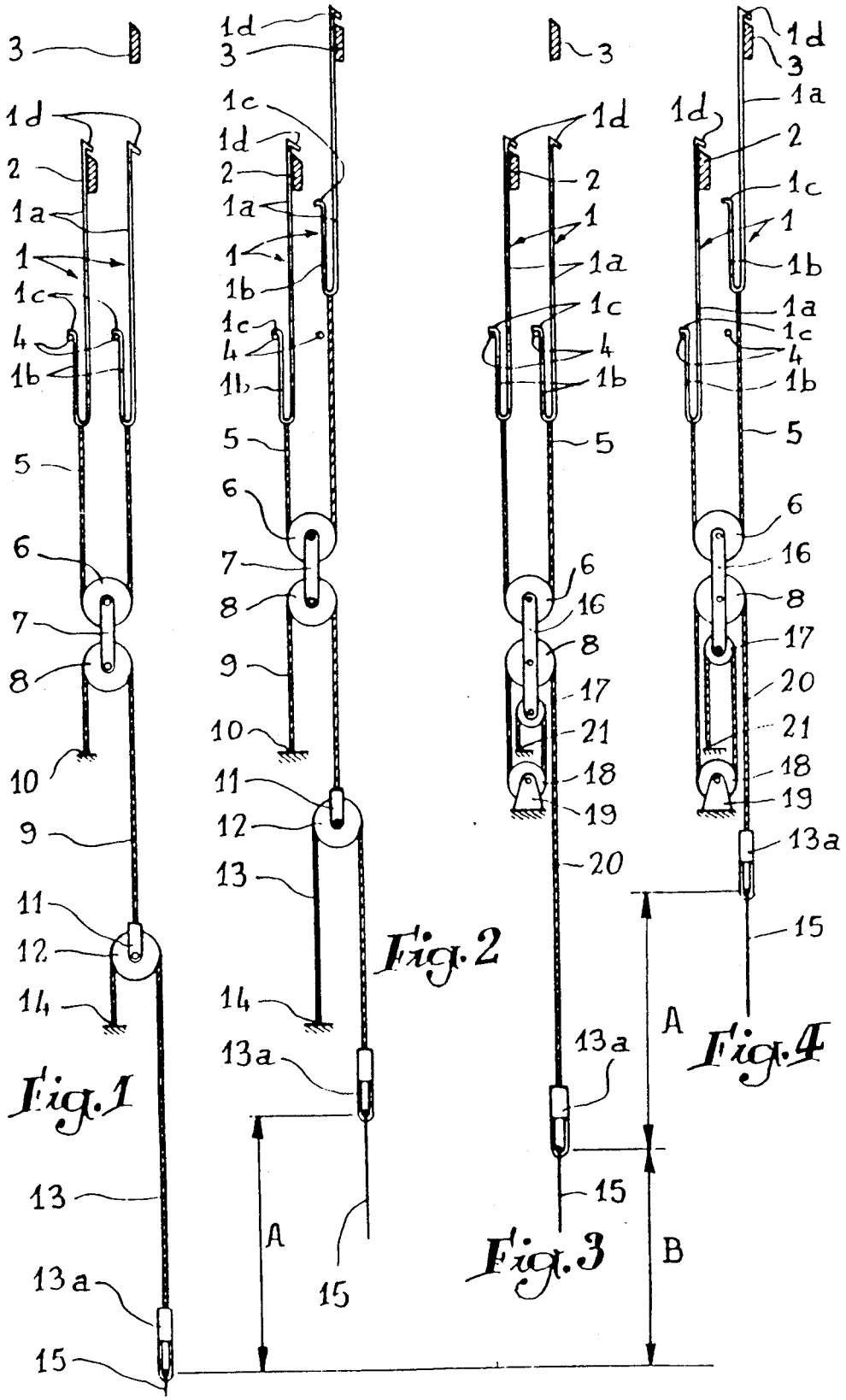
FIGS. 1 and 2 illustrate, with the shed in low and high position respectively, one of the systems used up to the present time.
FIGS. 3 and 4 are views similar to those of FIGS. 1 and 2, but illustrating a shed forming device according to the invention.

FIGS. 1 and 2 illustrate one of the unitary systems of a complex shed forming device, each system being intended for controlling a heddle or harness threads.

Each system comprises two identical hooks 1 each comprising two arms 1*a* and 1*b* of which the free end of the first is provided with a hook 1*a*, while that of the other short arm 1*b* comprises a catch 1*c*. The shed forming device comprises in known manner two knives 2, 3 which move in opposition in a reciprocating movement in order to raise or lower the hooks 1 which rest in their free state on the bars 4 of a grid (not shown) via their catches 1*c*. The two hooks are connected by a cord 5 passing around the first pulley 6 of a block and tackle or beam 7.

When it is question of a conventional shed forming device such as the one described in Pat. No. CH-367 452, the second pulley 8 of the block and tackle 7 is surrounded by a cord 9 of which one of the ends is anchored at a fixed point 10, while its free end carries a collar connected to the corresponding heddle. When it is desired to double the height of the shed, the free end of the cord 9 is associated with a fork joint 11 supporting an idle pulley 12. Around this pulley passes a funicular element 13 of which one of the ends is fixed with respect to a point 14 of the chassis of the device in question, its free end bearing a collar 13*a* associated with a heddle or harness threads 15.

The conventional functioning of such a shed forming device, which makes it possible to obtain a shed A of which the size is of the order of 200 mm, will not be described.

As has been explained hereinabove, the shed forming devices such as those comprising systems illustrated in FIGS. 1 and 2, are of a considerable height and are not compact. These drawbacks are overcome by using a system according to the invention, illustrated in FIGS. 3 and 4.

As in FIGS. 1 and 2, the present system includes two hooks 1, two knives 2 and 3, cord 5 and pulley 6 of a block and tackle or beam here referenced 16. This block and tackle carries the conventional second pulley 8 but, below it, a third idle pulley 17 has been mounted, while the bottom of the chassis of the device comprises, for each unitary mechanism, a guide pulley 18 rotating freely in a fixed fork joint 19.

In the embodiment according to the invention, the cord 9 and the funicular element 13 are replaced by one funicular element 20 of which one of the ends is anchored to a fixed point 21. Starting from this point, the element 20 successively passes partially around the idle pulley 17, then the guide pulley 18, and then rises to pass partially around the second pulley 8 of the block and tackle or beam 16 to then hang vertically so that its free end carrying a collar 13*a* is associated with a heddle or harness threads 15.

It will be observed that the diameter of the pulley 17 is smaller than that of the pulleys 6 and 8 and is located therebelow, while the diameter of the guide pulley 18 and its position are such that all the strands of element 20 are oriented parallel to one another.

Because of this block and tackle arrangement, a shed opening A is obtained, identical to that defined by the systems of FIGS. 1 and 2, but with a saving in height B of the shed forming device of about 170 to 200 mm, i.e. close to the value of the opening A of the shed. Of course, in the embodiment of FIGS. 3 and 4, it is necessary to guide the different block and tackles or beams 16 so that they do not interfere laterally with one another during the reciprocating movements of the hooks.

Cord 5 is advantageously attached at its ends to the two hooks of a shed forming device such as the one described in French Pat. No. 2 583 045. With such a structure, a perfect guiding of the beam is obtained, and an obvious facility of disposing the fixed pin of the pulley 18 transversely with respect to the lower part of the separating partitions which prevent any interference between the different block and tackles and easily support the points of anchoring 21.

Because of the structure according to the invention, either the height of shed opening may be doubled by maintaining the stroke of the knives, or the stroke may be reduced by half by conserving the original shed height.

It must, moreover, be understood that the foregoing description has been given only by way of example and that it in no way limits the domain of the invention which would not be exceeded by replacing the details of execution described by any other equivalents. In particular, the device may be oriented horizontally, obtaining the same effects.

We claim:

1. In a shed forming device for heddle or harness threads in a weaving loom having a frame which includes a plurality of mechanisms each composed of a pair of hooks vertically moveable under the effect of knives which move in opposition in a reciprocating manner, a first cord extending between the pair of hooks, a block and tackle having first and second pulleys, the first cord partially surrounding the first pulley, a second cord partially surrounding the second pulley, the improvement comprising, an idler pulley, one of the ends of the second cord being anchored to the frame and the other end thereof being connected to the heddle or harness threads, said idler pulley being mounted to rotate below said second pulley of the block and tackle, a lower guide pulley, said lower guide pulley being fixed to said frame, the second cord extending from said one end partially around said idler pulley and then partially around said lower guide pulley and then partially around said second pulley of the block and tackle to said other end which is connected to said heddle or harness threads.

2. The shed forming device of claim 1 in which the diameter of said idler pulley is less than that of the first and second pulleys of the block and tackle.

3. The shed forming device of claim 2 in which the diameter of the lower guide pulley is intermediate the diameter of said idler pulley and the second pulley of the block and tackle, and said lower guide pulley being fixed to said frame so that segments of the second cord extending between said idler pulley and said lower guide pulley, said lower guide pulley and said second pulley of said block and tackle and between said second pulley of said block and tackle to said other end thereof are oriented generally parallel with respect to one another.

* * * * *